United States Patent [19]

Williams

[11] 4,378,094

[45] Mar. 29, 1983

[54] MATERIAL REDUCING MILL BY-PASS FOR UNCRUSHABLES

[76] Inventor: Robert M. Williams, 16 La Hacienda, Ladue, St. Louis County, Mo. 63124

[21] Appl. No.: 234,633

[22] Filed: Feb. 17, 1981

[51] Int. Cl.[3] ..... B02C 13/286

[52] U.S. Cl. ..... 241/186 R

[58] Field of Search ..... 241/186 R, 186.2, 189 R, 241/189 A

[56] References Cited

U.S. PATENT DOCUMENTS

| | | | |
|---|---|---|---|
| 1,725,135 | 8/1929 | Gruendler . | |
| 2,491,661 | 12/1949 | Gruendler | 241/186 R X |
| 3,082,963 | 3/1963 | Gondard | 241/82 |
| 3,540,665 | 11/1970 | Snoek | 241/73 |
| 3,806,048 | 4/1974 | Williams | 241/189 A X |
| 4,009,836 | 3/1977 | Strom et al. | 241/189 A X |
| 4,011,999 | 3/1977 | Glaeser | 241/189 R X |

FOREIGN PATENT DOCUMENTS

| | | | |
|---|---|---|---|
| 18195 | 8/1956 | Fed. Rep. of Germany | 241/186 R |
| 2344582 | 4/1974 | Fed. Rep. of Germany | 241/189 R |

*Primary Examiner*—Howard N. Goldberg

*Attorney, Agent, or Firm*—Gravely, Lieder & Woodruff

[57] ABSTRACT

A material reducing mill having a material feeding conveyor delivering material to be reduced in the mill by falling onto a reducing rotor, and a by-pass gate adjacent the fall of the material and operable to direct material in by-pass of the reducing rotor for removing hard to reduce constituents from the falling material.

7 Claims, 3 Drawing Figures

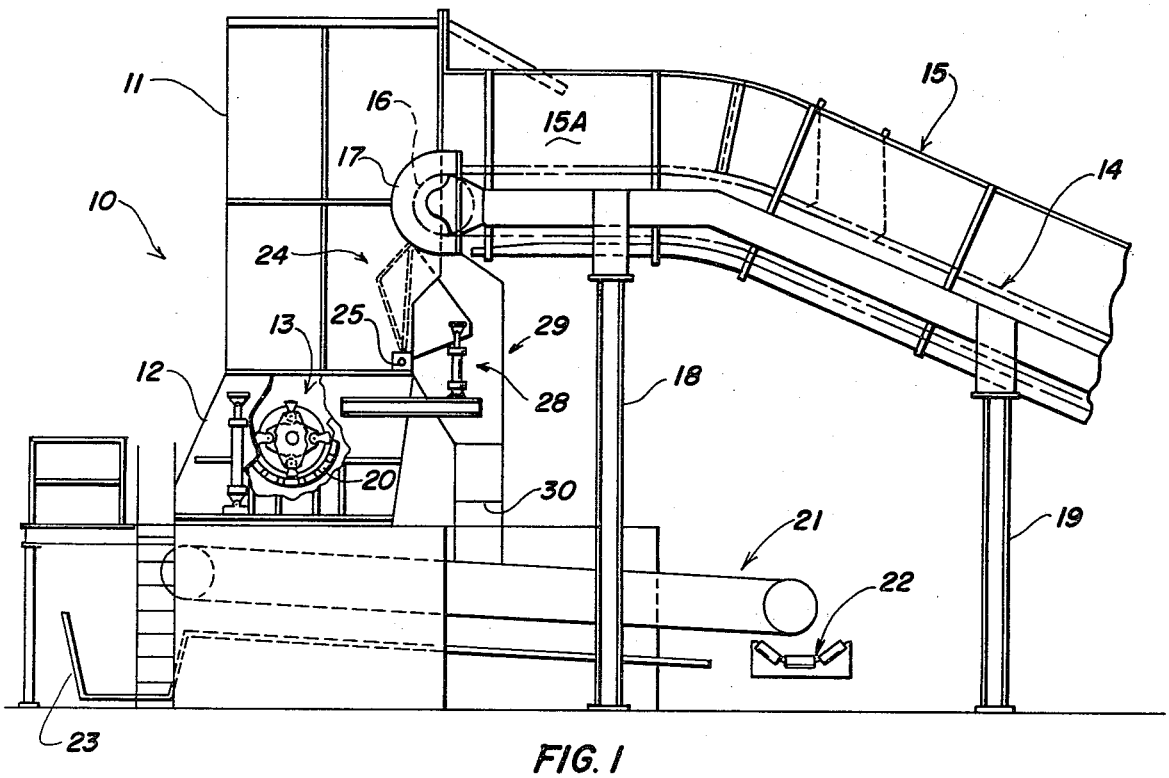
FIG. 1
FIG. 2
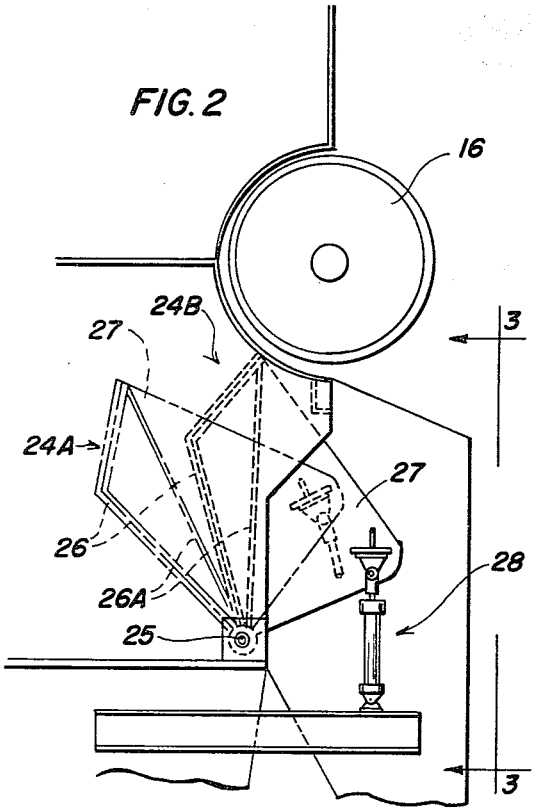
FIG. 3
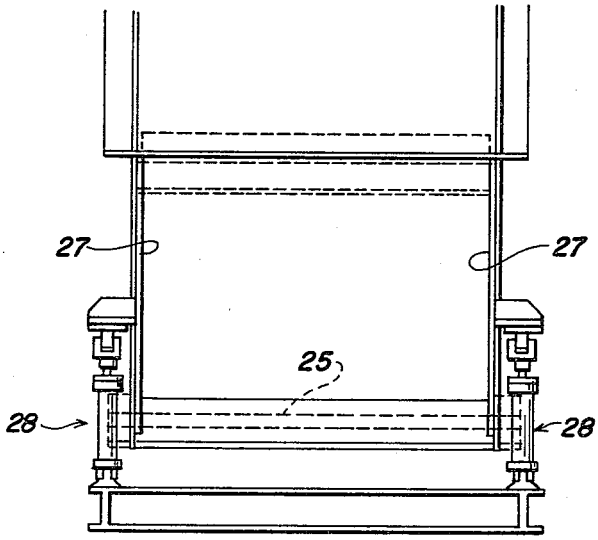

MATERIAL REDUCING MILL BY-PASS FOR UNCRUSHABLES

BACKGROUND OF THE INVENTION

1. Field of the Invention

This invention relates to means for protecting material reducing apparatus, and more particularly to a by-pass for directing uncrushable material around a material reducing hammer mill.

2. Description of the Prior Art

The prior art apparatus for reducing material by impact or shredding action has been provided with means to allow the hard to reduce or uncrushables to be thrown out to avoid damage. A typical trap or throw-out pocket is illustrated in the Gruendler U.S. Pat. No. 1,725,135 of Aug. 20, 1929. Another type of throw-out provision is seen in Gondard U.S. Pat. No. 3,082,963 of Mar. 26, 1963. A still further type of device for accomplishing the same general purpose is Snoek U.S. Pat. No. 3,540,665 of Nov. 17, 1970.

BRIEF SUMMARY OF THE INVENTION

The problem of removing hard to crush material and uncrushables is not always solved by providing throw-out traps or similar devices. Some reducing apparatus does not lend itself to trap devices, and examples thereof are the apparatus seen in Williams U.S. Pat. Nos. 3,667,694 of June 6, 1972 and 3,806,048 of Apr. 23, 1974.

It is, therefore, an important object of the present invention to provide material reducing apparatus with means for directing the hard-to-crush and uncrushable material in by-pass of the operating rotor so as to clear the apparatus of such material.

It is another object of the present invention to provide by-pass means for material which is recognized as being of the hard-to-crush material after it enters the apparatus, such by-pass means being operable from the exterior of the apparatus.

A further object of the present invention is directed toward providing safety means for material reducing apparatus, whereby it will not be necessary for an operator to enter any part of the apparatus to manually remove hard-to-crush material which has been entrained with the total flow of material and remains in the apparatus to be thrown around and be repeatedly caught in the incoming flow of material.

There is a need for ridding material reducing apparatus of hard-to-crush and uncrushable material without requiring operating personnel to enter the apparatus or its material feed conveyor to extract the offending components. That problem can be solved by incorporating a movable wall in the material feed structure which can be positioned when needed to open a by-pass passage to direct a small portion of the material with the objectional uncrushables out of the feed structure to a place where a reversible conveyor may be operated to complete the removal of the offending material from the general flow of material.

BRIEF DESCRIPTION OF THE DRAWINGS

In the drawings which illustrate a type of apparatus suitable for practicing the present invention:

FIG. 1 is a side view in elevation of the material reducing mill and its cooperating components;

FIG. 2 is a fragmentary view of the operating wall in the material feed structure in relation to the head pulley for the material feeding conveyor; and FIG. 3 is a view of the movable wall as seen along line 3—3 in FIG. 2.

DETAILED DESCRIPTION

With reference to FIG. 1 of the drawing, the material reducing mill 10 comprises a housing made up of a vertically directed feed stack 11 opening at its lower end over the casing 12 which encloses a rotary hammer assembly 13 which may be of a type shown in Williams U.S. Pat. No. 3,806,048. The hammer rotor is driven in the usual manner by an electric motor (not shown) and is positioned so as to be in the path of material delivered by a suitable conveyor 14 operably mounted in an enclosing structure 15 so as to deliver material to the head pulley 16 located in one wall of the feed stack 11 so as to be accessible for servicing by removal of a cover 17. The enclosure 15 for the conveyor 14 is suitably supported on columns 18 and 19.

The reduced material, after passing through the grate 20, is adapted to fall onto a conveyor 21 which is operable in reverse directions, but is intended to run in a normal direction rightwardly so as to dump the reduced material onto a take away conveyor 22. When the conveyor 21 operates in the opposite direction or leftwardly, it delivers material into a collecting container 23.

The feed stack 11 is provided with a movable gate means 24 which is pivotally mounted at its lower end on a pivot shaft 25 as shown in FIGS. 2 and 3. The gate means is formed with a deflecting surface 26 which is suitably formed with its outer surface functioning to direct material thrown upwardly in the feed stack by the hammer rotor 13 away from the head pulley 16 of the feed conveyor. The deflecting surface 26 extends the full width of the feed stack as shown in FIG. 3 and is provided with sidewalls 27 which, together with an interior wall 26A, make up a hollow structure in which the wall 26A and the sidewalls 27 form a chute for directing material falling from the head pulley 16 of the conveyor 14 when the gate means 24 is moved to its extended position 24A as shown in FIG. 2 by means of the pressure fluid motor 28 supplied in the usual manner from a pressure fluid system (not shown).

When the movable gate means 24 is moved to open the feed stack 11 in by-pass of the hammer rotor assembly 13, the inner surface of the wall 26A and the sidewalls 27 direct material into a by-pass passage 29 which has a discharge end 30 aligned with the conveyor 21. With the movable gate means in its open position 24A (FIG. 2), the surface 26 exposed in the feed stack 11 is in a position to deflect tramp iron material thrown upwardly from the rotor assembly 13 so that the head shaft of the conveyor is completely protected. Eventually the uncrushable material will ricochet onto the top of the feed conveyor, from which position it can be readily discharged down chute 24. When the movable gate 24 is in the closed position 24B, a portion of the wall 26 is in a position to guard against material being thrown against the underside of the head pulley 16.

In prior material reducing mills not equipped with the movable gate means and the by-pass 29, it has been the experience that hard to crush materials, and uncrushables are thrown upwardly in the feed stack 11 and ricochet so as to enter the area 15A of the conveyor enclosure 15 where it is returned to the feed stack 11 and again falls into the rotor assembly 13. Such material is again thrown out and eventually reenters the area 15A so that it repeats the previous cycle. If permitted to continue the repeating cycle, such material may damage the rotary assembly 13 and conveyor head shaft 16. Operating personnel of such prior material reducing mills have been known to shut down the conveyor and crawl into the enclosure 15 along the conveyor 14 for the purpose of locating the hard to crush material which would then be removed. Such procedure is dangerous and is not always successful, particularly when the conveyor 14 is fully loaded with material to be reduced. The present improvement permits operating personnel, when they detect by sound the noise caused by hard to crush material or uncrushables, to actuate the motor 28 to move the gate to open position 24B, thereby allowing the material in the area 15A to be by-passed around the rotor assembly 13. The result is that the chute formed thereby will direct a quantity of material, including the hard to crush material, into the by-pass passage 29. Concurrently with the operation of the motors 28, the drive for the conveyor 21 is reversed so that the by-passed material can be directed into container 23 and be separated from the remainder of the material normally delivered by the conveyor 21 to the take-away conveyor 22.

The foregoing specification and related drawings have presented a preferred embodiment of the present invention, but it should be apparent to those skilled in the relevant art to think of modifications which accomplish the same end result, and it is the purpose to include such modifications within the scope of the illustrated improvement.

What is claimed is:

1. In a material reducing mill comprising a mill housing having an inlet for material to be reduced; a material supply conveyor having its outlet at said housing inlet; a rotary material reducing assembly in said housing between said supply conveyor and an outlet for material reduced by said rotary reducing assembly; a gate in said mill housing pivotally mounted at a location adjacent and below the supply conveyor outlet; a material discharge passage having an outlet from said housing controlled by said gate; and means operably connected to said gate for positioning said gate selectively to close and open said discharge passage outlet from said housing, whereby upon said gate opening said passage outlet, material from the supply conveyor is directed into said discharge passage.

2. The material reducing mill of claim 1, wherein said pivotally mounted gate is formed with an external material deflecting surface and an interior surface, and spaced opposed sides in position to form with said interior surface a material directing chute for receiving material from said supply conveyor and directing it into said discharge passage.

3. The material reducing mill of claim 1 or claim 2, wherein a reversible collecting conveyor is located in alignment with said mill housing outlet and said discharge passage, said collecting conveyor running in one direction for moving material away from the mill housing reduced by said reducing assembly and running in the opposite direction for moving material from said discharge passage.

4. In a material reducing mill having a by-pass for uncrushables, comprising: a mill assembly having a material feed stack with a material feed opening and a mill casing connected to said stack; material reducing means in said mill casing operable to reduce material while throwing some material into said stack against material fed thereto; a material feed conveyor having an outlet end at said feed stack and a head pulley mounted at said opening into said feed stack above said mill casing; a material by-pass passage adjacent said mill casing for directing material to one side of said mill casing; gate means for closing and opening the by-pass passage, and when open, directing material from said feed conveyor into said by-pass passage; and means connected to and operable for positioning said gate means selectively to direct the fall of material from said feed conveyor into said by-pass passage and the flight of material thrown back into said feed stack from said mill casing away from said feed conveyor outlet, whereby said gate means acts as a guard to deflect material away from said feed conveyor head pulley while opening said by-pass passage for the fall of material into said by-pass passage.

5. The material reducing mill of claim 4 wherein said feed conveyor outlet connection into said feed stack is above said material by-pass passage and in substantial vertical alignment so that material falling off said feed conveyor outlet passes said by-pass passage; and said gate means is formed with wall means to catch the falling material and direct it into said by-pass passage.

6. The material reducing mill of claim 4 wherein said gate means includes wall means presenting a surface to deflect material thrown back in said feed stack from said mill casing to guard said feed conveyor head pulley.

7. In a material reducing mill having a by-pass for uncrushables comprising: a housing having a material receiving feed stack with an inlet opening and a casing spaced below said feed stack; a material reducing rotary assembly in said casing to reduce material fed into said feed stack; material conveying means having a discharge end in said feed stack inlet opening; an uncrushable by-pass passage adjacent said feed stack and having an inlet beneath said discharge end of said conveying means; gate means in said feed stack at said by-pass inlet, said gate means including a deflecting surface to direct material thrown upwardly in said feed stack by said rotary assembly away from said conveying means discharge end and means cooperating with said deflecting surface for directing material leaving said discharge end of said conveying means into said by-pass passage inlet; and operating means connected to said gate means for positioning its said cooperating means in positions selectively closing said by-pass passage inlet to entry of material and opening said by-pass inlet for entry of uncrushable material.

* * * * *